US006176156B1

(12) United States Patent
Coonrad

(10) Patent No.: US 6,176,156 B1
(45) Date of Patent: Jan. 23, 2001

(54) TRACTION SURFACE FOR A STRIKING TOOL

(75) Inventor: Todd Douglas Coonrad, Santa Cruz, CA (US)

(73) Assignee: Douglas Tool Inc., Santa Cruz, CA (US)

( * ) Notice: Under 35 U.S.C. 154(b), the term of this patent shall be extended for 0 days.

(21) Appl. No.: 09/406,915

(22) Filed: Sep. 24, 1999

Related U.S. Application Data

(63) Continuation-in-part of application No. 09/234,042, filed on Jan. 19, 1999, now Pat. No. 5,988,019.

(51) Int. Cl.[7] ..... B25D 1/00
(52) U.S. Cl. ..... 81/20
(58) Field of Search ..... 81/20, 21, 23, 81/25, 26; D8/78; 254/26 R

(56) References Cited

U.S. PATENT DOCUMENTS

| | | | | |
|---|---|---|---|---|
| D. 57,334 | * | 3/1921 | Hanford | D8/78 |
| D. 283,392 | * | 4/1986 | Gossage | D8/78 |
| D. 398,505 | * | 9/1998 | Gossage | D8/78 |
| 1,262,515 | * | 4/1918 | Kingsley | 81/20 |
| 1,526,251 | * | 1/1925 | Squier | 81/20 |
| 1,539,265 | * | 5/1925 | Mitchell | 81/20 |
| 2,906,150 | * | 9/1959 | Stewart | 81/20 |
| 4,200,130 | * | 4/1980 | Reamy | 81/20 |
| 4,336,832 | * | 6/1982 | Poulos | 81/20 |
| 5,590,868 | * | 1/1997 | Hebert et al. | 81/20 |

* cited by examiner

*Primary Examiner*—David A. Scherbel
*Assistant Examiner*—Joni B. Danganan
(74) *Attorney, Agent, or Firm*—Donald R Boys; Central Coast Patent Agency

(57) ABSTRACT

A traction pattern for a striking face of a striking tool has a plurality of indentions in the striking face, the indentions each forming a rectangular interface at the striking face. The indentions are arranged in a rectangular matrix in the striking face, producing thereby a striking surface being the areas at the striking face between the interfaces of the indentions at the striking face. The indentions can be in the form of four-sided truncated pyramids, each indention therefore having a rectangular bottom surface and four sides extending at a common obtuse angle from the bottom surface. Several unique traction surface patterns are taught, being formed by spacing between indentions and special treatment of the traction surface between the intersections of the indentions.

11 Claims, 4 Drawing Sheets

Figure 1:
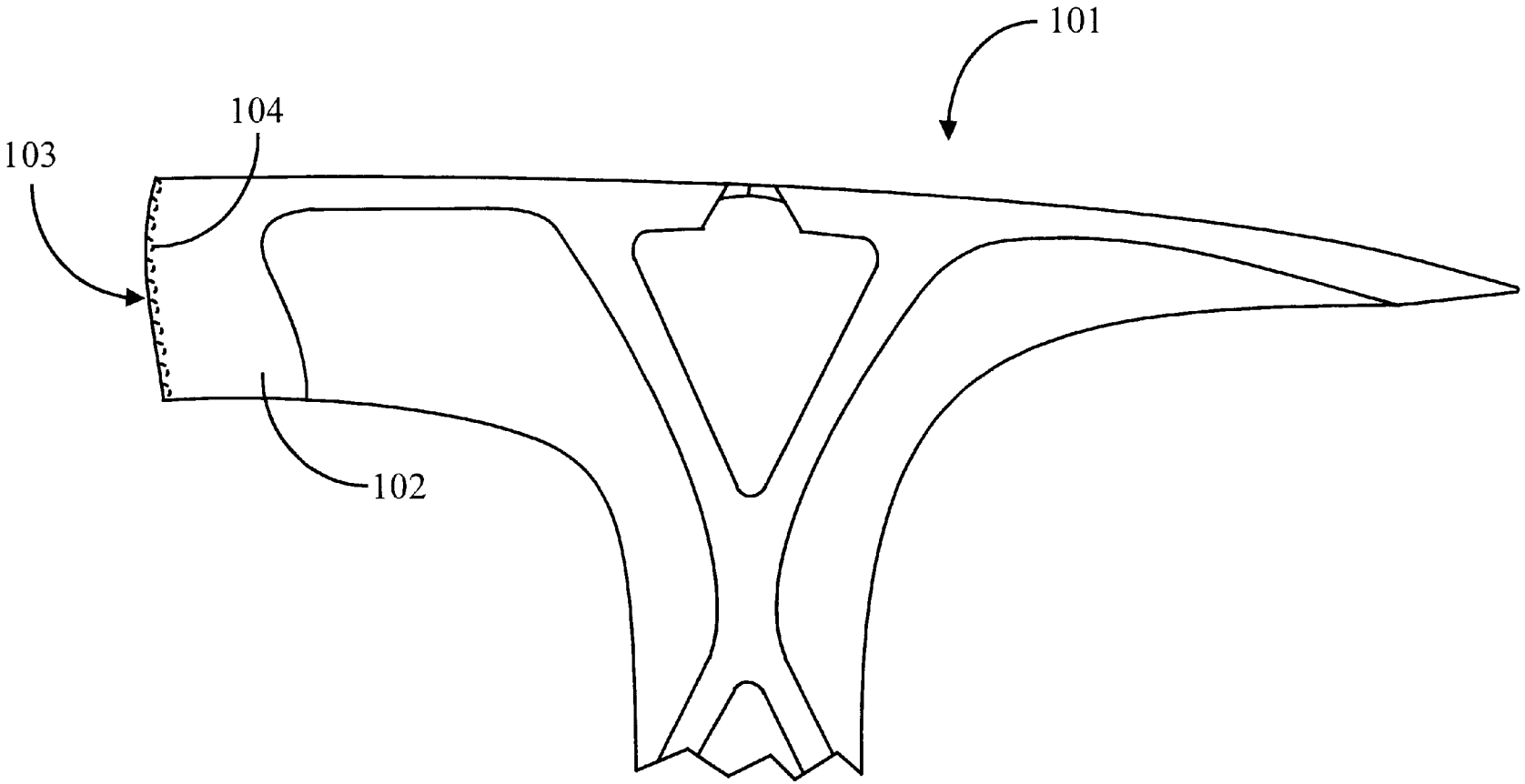

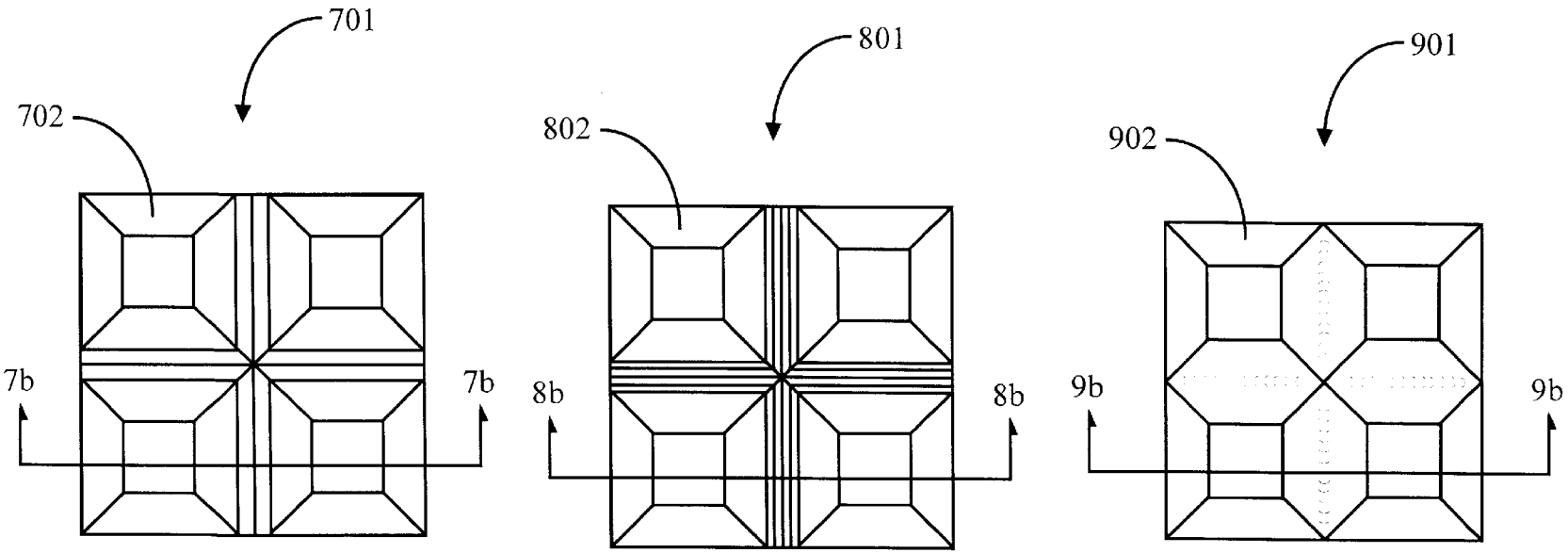
Fig. 9a
Fig. 8a
Fig. 7a
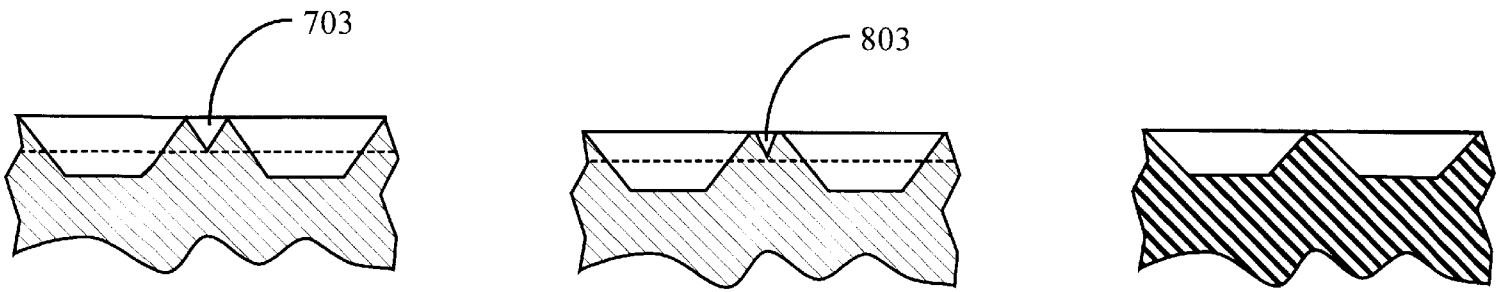
Fig. 9b
Fig. 8b
Fig. 7b

TRACTION SURFACE FOR A STRIKING TOOL

CROSS REFERENCE TO RELATED DOCUMENTS

This application is a continuation-in-part of application Ser. No. 09/234,042, filed Jan. 19, 1999, now U.S. Pat. No. 5,988,019 which is incorporated herein in its entirety by reference.

FIELD OF THE INVENTION

The present invention is in the area of hand-held striking tools, such as hammers, and pertains more specifically to traction surfaces on the head of a striking tool.

BACKGROUND OF THE INVENTION

Hand-held striking tools, such as claw hammers, sledge hammers, ball peen hammers, masonry hammers, and the like, have been used by people in a variety of disciplines for centuries as leveraged devices to provide a striking force to accomplish a variety of tasks. For example, a claw hammer is commonly used by carpenters to deliver sufficient striking force to drive a nail into wood. A sledge hammer is commonly used to deliver sufficient striking force for heavy work such as driving a stake, chisel, or wedge into masonry, stone, wood, or other hard materials. A masonry hammer is commonly used to strike masonry, stone, concrete, or similar hard materials for the purpose of breaking the material into smaller pieces. For example, to remove or modify an existing concrete walkway or portion thereof, a user may strike the concrete with the striking surface of the masonry hammer with sufficient force to break the concrete into smaller pieces, making it easier to remove the material.

Another common hand-held striking tool is a ball peen hammer, which has a substantially flat surface on one end and a rounded surface on the other end of its head, and is used to deliver sufficient striking force for shaping and fitting metal, and for driving machine chisels, rivet sets, machine wedges, and other similar tools.

Some hand-held striking devices, such as claw hammers, sledge hammers, masonry hammers and the like, have a traction texture on the striking surface of the impact head. Traction textures on a striking surface are commonly provided in a crosshatch, knurled, pebble-surfaced, grainy, or any sufficiently rough pattern. The purpose of traction texture is to improve friction between the impact head of a striking tool and an object being struck. Enhancing friction between the striking surface and an object being struck enhances a user's control of the direction and strength of impact. Traction textures are typically made by machining, drilling, etching, molding or other techniques well known in the art.

A problem with the traction texture on conventional impact heads is that the method by which the traction surfaces are produced results in a large number of small protruding elements from the striking surface. For example, milling, sawing, or molding grooves intersecting on a surface results in protrusions from the surface each having a quadrilateral cross-section, and of a length equal to the depth of the grooves. In many conventional textures pyramidal protrusions are molded into a surface providing a matrix of sharp points as a traction surface.

Protruding small structures as a traction surface have several drawbacks. One is that the structures tend to wear rather quickly causing the traction to deteriorate. Another is that striking a nail, rock, or some other hard object can cause one or more of the protruding structures to break or chip off, which not only deteriorates the traction but also may be quite dangerous.

What is clearly needed is an impact head traction surface that does not rely on numerous small protrusions to provide increased friction, and instead provides a contiguous striking surface that still enhances friction, and in which the arrangement of indentions is such as to provide particular friction-enhancing geometry.

SUMMARY OF THE INVENTION

In a preferred embodiment of the present invention a traction pattern for a striking face of a striking tool is provided, the traction pattern comprising a plurality of indentions in the striking face, the indentions each forming a rectangular interface at the striking face, the indentions arranged in a rectangular matrix in the striking face, producing thereby a striking surface being the areas at the striking face between the interfaces of the indentions at the striking face.

In some embodiments the indentions are in the form of four-sided truncated pyramids, each indention therefore having a rectangular bottom surface and four sides proceeding at a common obtuse angle with the bottom surface. In some embodiments the indentions are formed of two truncated pyramids, a first forming the bottom surface of the indention and having sides at a first angle with the bottom surface, and a second beginning at a plane parallel with the bottom surface and having sides at a second angle greater than the first angle, the second forming the rectangular intersection at the striking face.

The spacing of indentions in the rectangular matrix in some embodiments is such that each edge of the rectangular intersection at the striking surface for each indention adjacent to one or more other indentions is also an edge of the rectangular intersection at the striking surface for each adjacent indention, the pattern then forming a striking surface of sharp edges intersecting at right angles. In some cases the intersections of the indentions at the striking face have sides of equal length, forming square intersections at the striking face.

In some embodiments of the invention the spacing of the indentions in the rectangular matrix is such that each edge of the rectangular intersection at the striking surface for each indention adjacent to one or more other indentions is parallel to an edge of the rectangular intersection at the striking surface for each adjacent indention, the pattern then forming a striking surface of intersecting flat surfaces at right angles, the width of the flat surfaces being a function of the spacing of the indentions, with the intersecting pattern of flat surfaces forming a contiguous striking surface.

Also in some embodiments the spacing of the indentions in the rectangular matrix is such that each edge of the rectangular intersection at the striking surface for each indention adjacent to one or more other indentions is parallel to and spaced apart from an edge of the rectangular intersection at the striking surface for each adjacent indention, and further comprising v-grooves formed in the areas between the edges of intersections of the indentions, the v-grooves forming a rectangular matrix of v-grooves in the areas between the intersections of the indentions with the striking face. The shape and depth of the v-grooves may be such that each edge of each intersection of an indention adjacent to another indention is a sharp upward-facing v-edge. The shape and depth of the v-grooves also may be such that the striking surface is a series of intersecting flat surfaces in the plane of the striking face. In still other embodiments the areas between the intersections of the indentions at the striking face are rounded from each indention to the adjacent indentions, the striking surface then being a rectangular matrix of upward-facing rounded edges.

In another aspect of the invention a striking tool having a head with a striking face, a handle interface, and a handle is provided, wherein the striking face comprises a traction pattern comprising a plurality of indentions in the striking face, the indentions each forming a rectangular interface at the striking face, the indentions arranged in a rectangular matrix in the striking face, producing thereby a striking surface being the areas at the striking face between the interfaces of the indentions at the striking face. A hammer is a good example of such a striking tool.

In various embodiments of the invention disclosed in enabling detail below, for the first time a traction surface for a hammer is provided which not only presents a contiguous surface at the striking face, avoiding breakage common with separate projections from the surface, but also provides that surface in a number of rectangular patterns of edges that enhance the traction action of the striking face.

BRIEF DESCRIPTION OF THE DRAWING FIGURES

FIG. 1 is a side view of a tool 101 showing an impact head 102, a striking surface 103, and a traction texture 104 as used according to an embodiment of the present invention.

Figure 2:
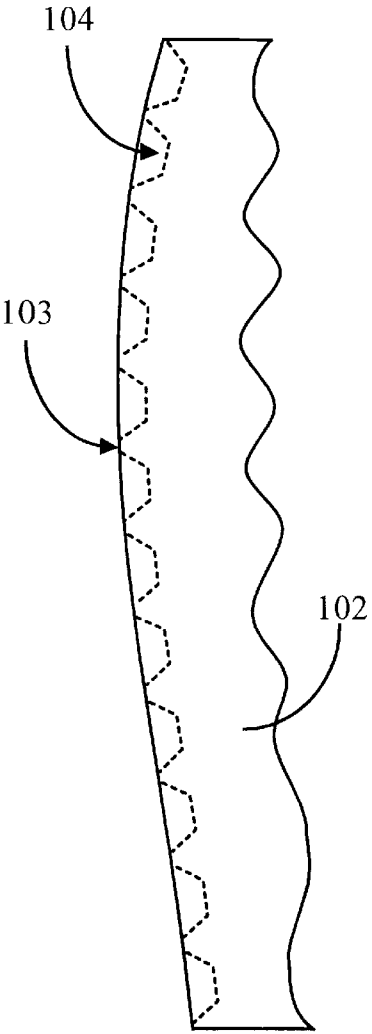

FIG. 2 is a side view of the impact head 102, showing striking surface 103 and traction texture 104 of the tool of FIG. 1.

Figure 3:
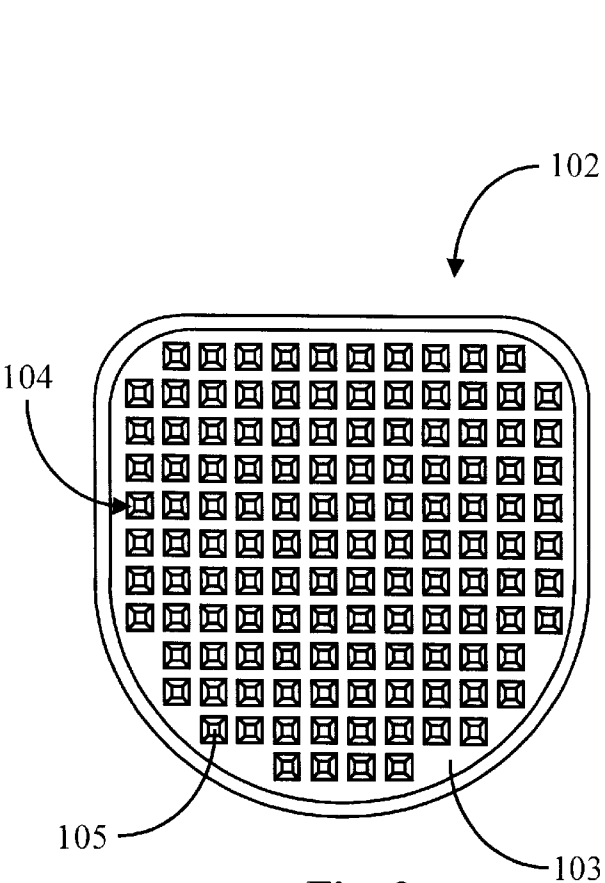

FIG. 3 is an enlarged face-on view of the impact head 102 showing traction texture 104 and striking surface 103 of FIG. 1, and voids 105.

Figures 4A, 4B, 5A, 5B, 6A, 6B:
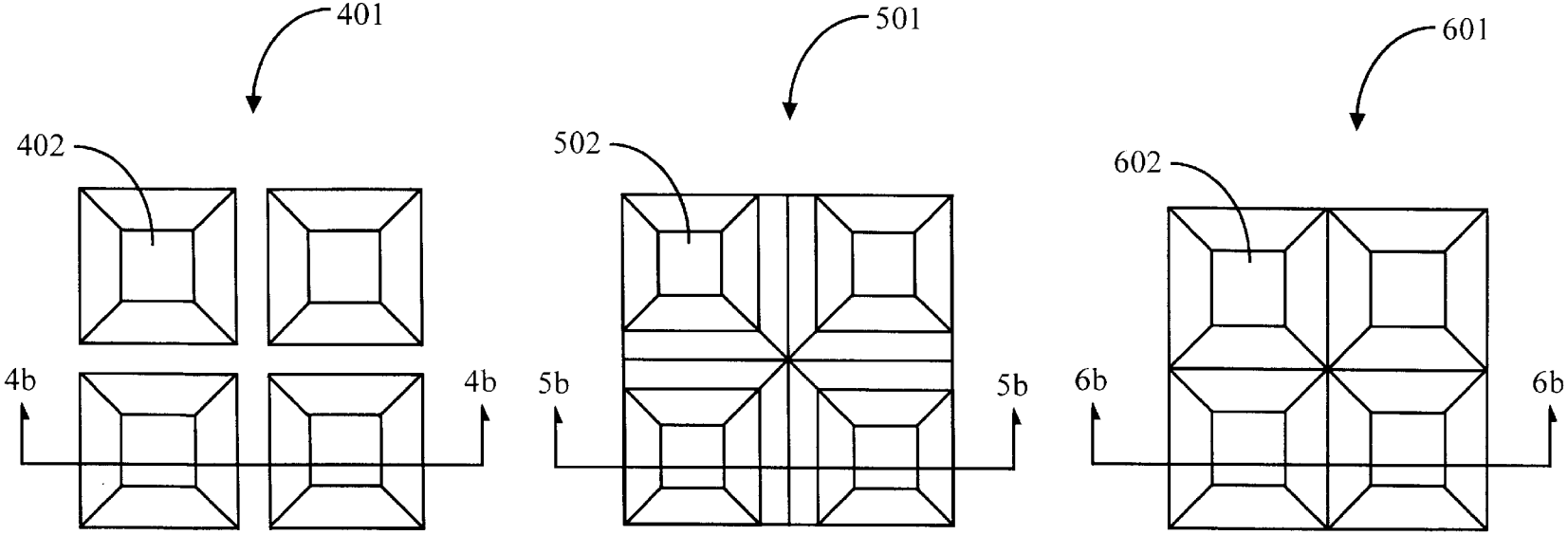

FIG. 4*a* is an enlarged face-on view of a traction texture similar to that of FIG. 2.

FIG. 4*b* is a section view of the traction texture of FIG. 4*a* taken along section line 4*b*—4*b* of FIG. 4*a*.

FIG. 5*a* is an enlarged face-on view of a traction texture as used in an alternative embodiment of the present invention.

FIG. 5*b* is a section view of the traction texture of FIG. 5*a* taken along section line 5*b*—5*b* of FIG. 5*a*.

FIG. 6*a* is an enlarged face-on view of a traction texture as used in another alternative embodiment of the present invention.

FIG. 6*b* is a section view of the traction texture of FIG. 6*a* taken along section line 6*b*—6*b* of FIG. 6*a*.

FIG. 7*a* is an enlarged face-on view of a traction texture as used in another alternative embodiment of the present invention.

FIG. 7*b* is a section view of the traction texture of FIG. 7*a* taken along section line 7*b*—7*b* of FIG. 7*a*.

FIG. 8*a* is an enlarged face-on view of a traction texture as used in another alternative embodiment of the present invention.

FIG. 8*b* is a section view of the traction texture of FIG. 8*a* taken along section line 8*b*—8*b* of FIG. 8*a*.

FIG. 9*a* is an enlarged face-on view of a traction texture as used in another alternative embodiment of the present invention.

FIG. 9*b* is a section view of the traction texture of FIG. 9*a* taken along section line 9*b*—9*b* of FIG. 9*a*.

DESCRIPTION OF THE PREFERRED EMBODIMENTS

FIG. 1 is a side view of a tool 101 showing an impact head 102, a striking surface 103, and a traction texture 104 as used according to an embodiment of the present invention. FIG. 2 is a side view of impact head 102, showing striking surface 103 and traction texture 104 of the tool of FIG. 1. The present invention, in various embodiments, overcomes problems known in the art with the traction textures of conventional striking surfaces. For example, a common technique well known in the art for producing conventional traction textures is by milling, sawing, or molding grooves intersecting on a striking surface, creating protruding small structures as a traction texture. One problem with the traction texture produced in this manner is the structures tend to wear more quickly, causing the traction to deteriorate. Also, the structures can break or chip off when striking some other hard object, deteriorating the traction and causing a hazardous condition. The present invention in various embodiments also provides a contiguous striking surface more wear resistant then previous striking surfaces known in the art, without deteriorating the friction.

FIG. 3 is an enlarged face-on view of impact head 102 showing traction texture 104, voids 105, and striking surface 103 of FIG. 1. A salient difference between the striking surface in the embodiment of the invention described by FIG. 3 and conventional striking surfaces, is that the striking surface in the embodiment of the invention is a contiguous surface over the area of striking surface 103. The actual striking surface is the contiguous area between voids 105. There are no individual protrusions which may break off as in conventional striking surfaces.

FIG. 4*a* is an enlarged face-on view of a traction texture 401 showing a void 402 similar to void 105 of FIG. 3. FIG. 4*b* is a section view of the traction texture of FIG. 4*a* taken along section line 4*b*—4*b* of FIG. 4A. Texture 401 in this embodiment is provided by making voids substantially in the shape of a truncated pyramid and arranging the voids in a rectangular matrix as shown in FIG. 3. The rectangular area between the voids forms the actual striking surface.

FIG. 5*a* is an enlarged face-on view of a traction texture 501 showing a void 502 as used in an alternative embodiment of the present invention. FIG. 5*b* is a section view of the traction texture of FIG. 5*a* taken along section line 5*b*—5*b* of FIG. 5A. Texture 501 in this embodiment is provided by making voids substantially in the shape of a truncated pyramid and arranged side-by-side as shown in FIG. 5*a*. The sharp lines between the voids form the actual striking surface. In this embodiment, because of the obtuse angles formed by the attributes and arrangement of the voids of FIG. 5*b*, greater rigidity and resistance to chipping and other damage should be expected.

FIG. 6*a* is an enlarged face-on view of a traction texture 601 showing a void 602 as used in another alternative embodiment of the present invention. FIG. 6*b* is a section view of the traction texture of FIG. 6*a* taken along section line 6*b*—6*b* of FIG. 6A. Texture 601 in this embodiment is provided by making voids substantially in the shape of a truncated pyramid and arranged side-by-side as shown in FIG. 6*a*. The sharp lines between the voids form the actual striking surface.

FIG. 7*a* is an enlarged face-on view of a traction texture 701 showing a void 702 and a void 703 as used in another alternative embodiment of the present invention. FIG. 7*b* is a section view of the traction texture of FIG. 7*a* taken along section line 7*b*—7*b* of FIG. 7A. Texture 701 in this embodiment is provided by making voids substantially in the shape of a truncated pyramid, separated by void 703 and arranged side-by-side as shown in FIG. 7*a*. The sharp lines between the voids form the actual striking surface. In this embodiment the areas between the pyramidal voids have triangular grooves providing a greater number of sharp edges in the striking surface.

FIG. 8*a* is an enlarged face-on view of a traction texture 801 showing a void 802 and a void 803 as used in another alternative embodiment of the present invention. FIG. 8*b* is a section view of the traction texture of FIG. 8*a* taken along section line 8*b*—8*b* of FIG. 8A. Texture 801 in this embodiment is provided by making voids substantially in the shape of a truncated pyramid, separated by void 803 and arranged side-by-side as shown in FIG. 8*a*. The rectangular areas between the voids form the actual striking surface. In this embodiment the triangular groove is more shallow than that of FIG. 7*a* and FIG. 7*b* providing flat tops in the striking surface instead of sharp edges.

FIG. 9*a* is an enlarged face-on view of a traction texture 901 showing a void 902 as used in another alternative embodiment of the present invention. FIG. 9*b* is a section view of the traction texture of FIG. 9*a* taken along section line 9*b*—9*b* of FIG. 9*a*. Texture 901 in this embodiment is provided by making voids substantially in the shape of a truncated pyramid with a rounded surface between the voids. In this embodiment, because of the rounded surface formed by the arrangement of the voids of FIG. 9*a*, greater rigidity and resistance to chipping and other damage should be expected.

It will be apparent to a worker of ordinary skill that there are many alterations that may be made in the embodiments described herein without departing from the spirit and scope of the invention. For example, voids and other indentions of many shapes and depths may be made into the striking surface, and in a wide variety of patterns within the spirit and scope of the invention. For example, the voids illustrated as truncated pyramids may be fully pyramidal, rather than truncated, in which case the bottom of each void into the striking region of the hammer will terminate at a point. The cross-section shape of voids in such an embodiment, parallel to the plane of the striking surface will still be rectangular, or square which is a special case of rectangular. The shapes and patterns described above as embodiments are exemplary. Also, the method of manufacture of such striking surfaces may utilize a wide variety of processes. For example, the striking surface could be formed by casting the striking surface along with the voids, or by forging the voids into an existing striking surface. The methods of manufacture may vary to suit the different purposes of the resulting traction texture. For these reasons the invention should be afforded the broadest possible scope limited only by the claims that follow.

What is claimed is:

1. A traction pattern for a striking face of a striking tool, the traction pattern comprising a plurality of indentions in the striking face, the indentions are in the form of four-sided truncated pyramids, each indention therefore having a rectangular bottom surface and four sides extending at a common obtuse angle from the bottom surface, the indentions each forming a rectangular interface at the striking face the indentions arranged in a rectangular matrix in the striking face, producing thereby a striking surface being the areas at the striking face between the interfaces of the indentions at the striking face.

2. The traction pattern of claim 1 wherein each indention is formed of two truncated pyramids, a first forming the bottom surface of the indention and having sides at a first angle with the bottom surface, and a second beginning at a plane parallel with the bottom surface and having sides at a second angle greater than the first angle, the second forming a rectangular intersection at the striking face.

3. The traction pattern of claim 1 wherein the spacing of the indentions in the rectangular matrix is such that each edge of a rectangular intersection at the striking surface for each indention adjacent to one or more other indentions is also an edge of the rectangular intersection at the striking surface for each adjacent indention, the pattern then forming a striking surface of sharp edges.

4. The traction pattern of claim 1 wherein intersections of the indentions at the striking face have sides of equal length, forming square intersections at the striking face.

5. The traction pattern of claim 1 wherein the spacing of the indentions in the rectangular matrix is such that each edge of a rectangular intersection at the striking surface for each indention adjacent to one or more other indentions is parallel to an edge of the rectangular intersection at the striking surface for each adjacent indention, the pattern then forming a striking surface of intersecting flat surfaces, the width of the flat surfaces being a function of the spacing of the indentions, with the intersecting pattern of flat surfaces forming a contiguous striking surface.

6. The traction pattern of claim 1 wherein the spacing of the indentions in the rectangular matrix is such that each edge of a rectangular intersection at the striking surface for each indention adjacent to one or more other indentions is parallel to and spaced apart from an edge of the rectangular intersection at the striking surface for each adjacent indention, and further comprising v-grooves formed in the areas between the edges of intersections of the indentions, the v-grooves forming a rectangular matrix of v-grooves in the areas between the intersections of the indentions with the striking face.

7. The traction pattern of claim 6 wherein the shape and depth of the v-grooves is such that each edge of each intersection of an indention adjacent to another indention is a sharp upward-facing v-edge.

8. The traction pattern of claim 6 wherein the shape and depth of the v-grooves is such that the striking surface is a series of intersecting flat surfaces in the plane of the striking face.

9. The traction surface of claim 1 wherein the areas between the intersections of the indentions at the striking face are rounded from each indention to the adjacent indentions, the striking surface then being a rectangular matrix of upward-facing rounded edges.

10. A striking tool having a head with a striking face, a handle interface, and a handle, wherein the striking face comprises a traction pattern comprising a plurality of indentions in the striking face, the indentions are in the form of four-sided truncated pyramids each indention therefore having a rectangular bottom surface and four sides extending at a common obtuse angle from the bottom surface, the indentions each forming a rectangular interface at the striking face, the indentions arranged in a rectangular matrix in the striking face, producing thereby a striking surface being the areas at the striking face between the interfaces of the indentions at the striking face.

11. The striking tool of claim 10 wherein the striking tool is implemented as a hammer.

* * * * *